US012171316B1

(12) United States Patent
Oh

(10) Patent No.: US 12,171,316 B1
(45) Date of Patent: Dec. 24, 2024

(54) HOLDER AND ITEM STORAGE APPARATUS FOR PORTABLE ELECTRONIC EQUIPMENT

(71) Applicant: SPIGEN KOREA CO., LTD., Seoul (KR)

(72) Inventor: Seungwoo Oh, Seoul (KR)

(73) Assignee: SPIGEN KOREA CO., LTD., Seoul (KR)

( * ) Notice: Subject to any disclaimer, the term of this patent is extended or adjusted under 35 U.S.C. 154(b) by 0 days.

(21) Appl. No.: 18/819,106

(22) Filed: Aug. 29, 2024

(51) Int. Cl.

| | |
|---|---|
| ***A45C 11/24*** | (2006.01) |
| ***A45C 11/00*** | (2006.01) |
| ***A45C 13/00*** | (2006.01) |
| ***A45C 13/02*** | (2006.01) |

(52) U.S. Cl.
CPC ..... *A45C 11/24* (2013.01); *A45C 13/005* (2013.01); *A45C 13/02* (2013.01); *A45C 2011/002* (2013.01); *A45C 2013/025* (2013.01); *A45C 2200/15* (2013.01)

(58) Field of Classification Search
CPC ..... A45C 11/24; A45C 13/005; A45C 11/26; A45C 13/02; A45C 2013/025; A45C 2011/002; A45C 2200/15; A45C 13/002; A45C 13/08; A45C 2011/001; A45C 2011/003; A45C 11/38
USPC ..... 206/216, 38, 581, 320, 576, 223, 234
See application file for complete search history.

(56) References Cited

U.S. PATENT DOCUMENTS

| | | | | |
|---|---|---|---|---|
| 1,403,883 | A * | 1/1922 | Woods | A47J 47/005 269/309 |
| 3,371,975 | A * | 3/1968 | Meltzer | B25H 3/006 206/349 |
| 8,172,077 | B1 * | 5/2012 | Gray | B25H 1/04 190/18 R |
| 8,602,039 | B1 * | 12/2013 | Gindi | H04M 1/21 206/823 |
| 9,571,147 | B1 * | 2/2017 | Chang | H04B 1/3888 |
| 11,653,732 | B2 * | 5/2023 | Tsai | H02J 7/0044 381/380 |
| 2008/0156669 | A1 * | 7/2008 | Law | A45C 11/38 224/679 |
| 2008/0156670 | A1 * | 7/2008 | Law | A45C 11/38 206/216 |

(Continued)

FOREIGN PATENT DOCUMENTS

| | | | |
|---|---|---|---|
| KR | 10-2312161 | B1 | 10/2021 |
| KR | 10-2388799 | B1 | 4/2022 |

*Primary Examiner* — Rafael A Ortiz
(74) *Attorney, Agent, or Firm* — Bridgeway IP Law Group, PLLC; Jihun Kim

(57) ABSTRACT

A holder and item storage apparatus for portable electronic equipment capable of holding and charging portable electronic equipment, such as a smartwatch, and storing accessories is disclosed. A holder and item storage apparatus for portable electronic equipment includes a first frame part, a second frame part provided at a distance in a lower portion of the first frame part at a space, a holding part provided on the first frame part to hold the portable electronic equipment, a rotating part vertically connected to the first frame part and the second frame part, and a storage box disposed between the first frame part and the second frame part, wherein the storage box is connected to the rotating part to rotate in a horizontal direction and includes an internal space capable of storing items.

20 Claims, 13 Drawing Sheets

(56) References Cited

U.S. PATENT DOCUMENTS

| | | | | |
|---|---|---|---|---|
| 2016/0087469 | A1* | 3/2016 | Armstrong | H02J 7/0044<br>320/107 |
| 2016/0373152 | A1* | 12/2016 | Schmidt | A45C 11/00 |
| 2018/0069585 | A1* | 3/2018 | Azodi | A45D 42/02 |
| 2022/0192335 | A1* | 6/2022 | Maguire | A45C 13/1069 |

* cited by examiner

HOLDER AND ITEM STORAGE APPARATUS FOR PORTABLE ELECTRONIC EQUIPMENT

CROSS-REFERENCE TO RELATED APPLICATIONS

This application claims priority to and the benefit of Korean Patent Application No. 10-2024-0093776, filed on Jul. 16, 2024, the disclosure of which is incorporated herein by reference in its entirety.

FIELD

The present disclosure relates to a holder and item storage apparatus for portable electronic equipment, and more particularly, to a holder and item storage apparatus for portable electronic equipment capable of holding and charging portable electronic equipment, such as a smartwatch and storing accessories therefor.

BACKGROUND

In our modern lives, various types of portable electronic devices, such as a smartphone, a digital camera, a MP3 player, and PMP, are widely spread and used. These days, a wide variety of electronic devices, such as a smartwatch worn on a wrist and a wireless earphone with a Bluetooth function, are being used. Users go out with these electronic devices and use them outside, and then, plug these electronic devices into a charger for later use upon returning to their homes or to the offices.

In the portable electronic devices, in addition to a charging cable, a dock may be provided as a means of charging. Since the dock is provided individually for each device, the design and shape of the dock may be different from device to device. Thus, multiple portable electronic devices may require a spacious room at home to properly store docks of various designs and shapes, which may result in chargers left cluttered on a desk or a floor.

In addition, the smartwatch and wireless earphone may require a case for charging or storage when they are not in use. Additionally, users of the portable electronic devices or wearable devices may need to carry multiple cases separately, and carrying these accessories may be inconvenient for the users.

SUMMARY

The present disclosure has been devised to solve the above-described problems, and an object of the present disclosure provides a holder and item storage apparatus for portable electronic equipment capable of holding and charging portable electronic equipment, such as a smartphone and a smart watch, and storing accessories for user convenience.

Objects of the present disclosure are not limited to the above-mentioned objects. That is, other objects that are not mentioned may be obviously understood by those skilled in the art from the following description.

According to an embodiment of the present disclosure, a holder and item storage apparatus for portable electronic equipment includes a first frame part, a second frame part provided at a distance in a lower portion of the first frame part, a holding part provided on the first frame part to hold the portable electronic equipment, a rotating part vertically connected to the first frame part and the second frame part, and a storage box disposed between the first frame part and the second frame part, wherein the storage box is connected to the rotating part to rotate in a horizontal direction and includes an internal space capable of storing items.

In one example embodiment, the first frame part includes a main body frame disposed in an upper portion of the storage box and an upper frame provided in an upper portion of the main body frame, wherein the upper frame has a charging part formed to connect the holding part. The charging part is formed with at least one fitting protrusion to hold a cable.

In one example embodiment, the holding part includes a holder provided in the charging part of the first frame part, a hinge connected to the holder to rotate the holder, and an angle adjustment member connected to the first frame part and fitted with the hinge. In one example embodiment, the rotating part includes a rotating shaft connected to the first frame part and the second frame part and a bearing connected to the rotating shaft for smooth rotation of the storage box.

In one example embodiment, the storage box includes a housing that is provided with an insertion groove formed to connect the rotating part and a storage rack that is accommodated inside the housing. The storage rack is formed with at least one insertion part to store items, and the insertion part is separated by at least one partition wall.

In one example embodiment, the second frame part includes a lower frame that supports the first frame part and the storage box and a connecting piece disposed in an upper portion of one side of the lower frame and connected to the first frame part and contacts the storage box. An inside of the lower frame is provided with at least one weight. A bottom surface of the lower frame is provided with at least one anti-slip pad. The holder and item storage apparatus further includes at least one magnet that is provided on the first frame part and the storage box to stop a rotation of the storage box.

According to another embodiment of the present disclosure, a holder and item storage apparatus for portable electronic equipment includes a first frame part, a second frame part provided at a distance in a lower portion of the first frame part, a holding part provided on the first frame part and has a wireless charging module for charging a battery built into the portable electronic equipment, a rotating part vertically connected to the first frame part and the second frame part, and a storage box disposed between the first frame part and the second frame part, wherein the storage box is connected to the rotating part to rotate in a horizontal direction and includes an internal space capable of storing items.

According to yet another embodiment of the present disclosure, a holder and item storage apparatus for portable electronic equipment includes a first frame part, a second frame part provided at a distance in a lower portion of the first frame part, a holding part provided on the first frame part to move in a sliding manner through a guide member, a rotating part vertically connected to the first frame part and the second frame part, and a storage box disposed between the first frame part and the second frame part, wherein the storage box is connected to the rotating part to rotate in a horizontal direction and includes an internal space capable of storing items.

BRIEF DESCRIPTION OF THE FIGURES

Example embodiments are illustrated by way of example and not limitation in the figures of the accompanying drawings, in which like references indicate similar elements and in which.

Figure 1:
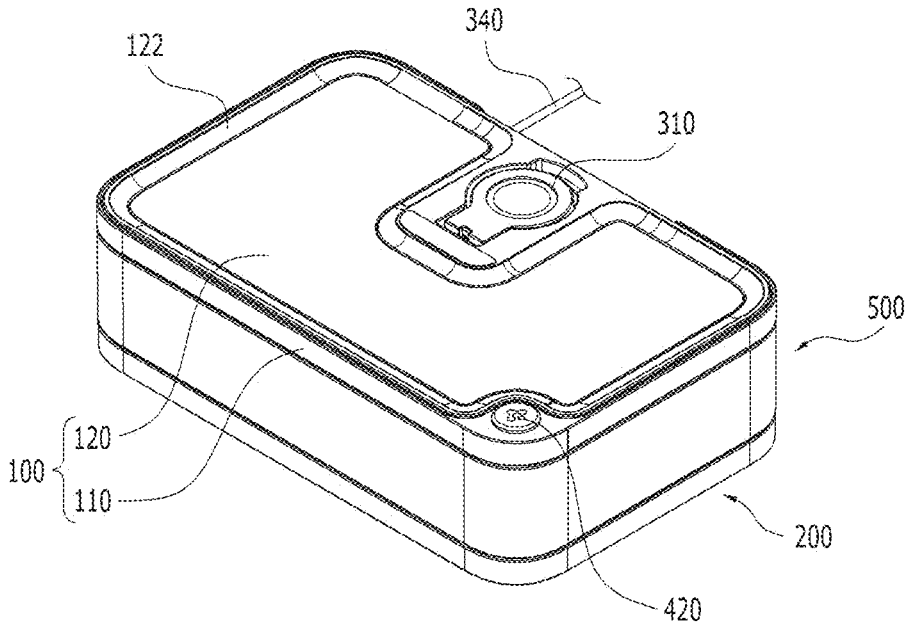
FIG. 1 is a perspective view illustrating a holder and item storage apparatus for portable electronic equipment, according to the present disclosure.

Other features of the present embodiments will be apparent from the accompanying drawings and from the detailed description that follows.

DETAILED DESCRIPTION

Various advantages and features of the present disclosure and methods accomplishing them will become apparent from the following description of embodiments with reference to the accompanying drawings. However, the present disclosure is not limited to embodiments disclosed below, and may be implemented in various different forms, these embodiments will be provided only in order to make the present disclosure complete and allow one of ordinary skill in the art to which the present disclosure pertains to completely recognize the scope of the present disclosure, and the present disclosure will be defined by the scope of the claims. Accordingly, in some embodiments, well-known process steps, well-known element structures, and well-known technologies are not specifically described in order to avoid ambiguous interpretation of the present disclosure. Throughout the specification, the same components will be denoted by the same reference numerals.

The spatially relative terms 'below', 'beneath', 'lower', 'above', 'upper', and the like, may be used in order to easily describe correlations between one element or component and other elements or components as illustrated in the drawings. The spatially relative terms are to be understood as terms including different directions of elements at the time of being used or at the time of operating in addition to directions illustrated in the drawings. For example, when elements illustrated in the drawings are overturned, an element described as 'below or beneath' another element may be put 'above' another element. Accordingly, an illustrative term "below" may include both of a downward direction and an upward direction. Elements may be oriented in other directions as well, and accordingly, the spatially relative terms may be interpreted according to orientations.

The terms as used herein are for describing embodiments rather than limiting the present disclosure. Unless explicitly described to the contrary, a singular form includes a plural form in the present specification. The terms "comprise" and/or "comprising" as used herein do not exclude the existence or addition of one or more other components, steps, operations, and/or elements in addition to the mentioned components, steps, operations, and/or elements.

Unless defined otherwise, all the terms (including technical and scientific terms) used herein have the same meaning as meanings commonly understood by one of ordinary skill in the art to which the present disclosure pertains. In addition, the terms defined in generally used dictionaries are not ideally or excessively interpreted unless they are specifically defined clearly.

Figure 2:
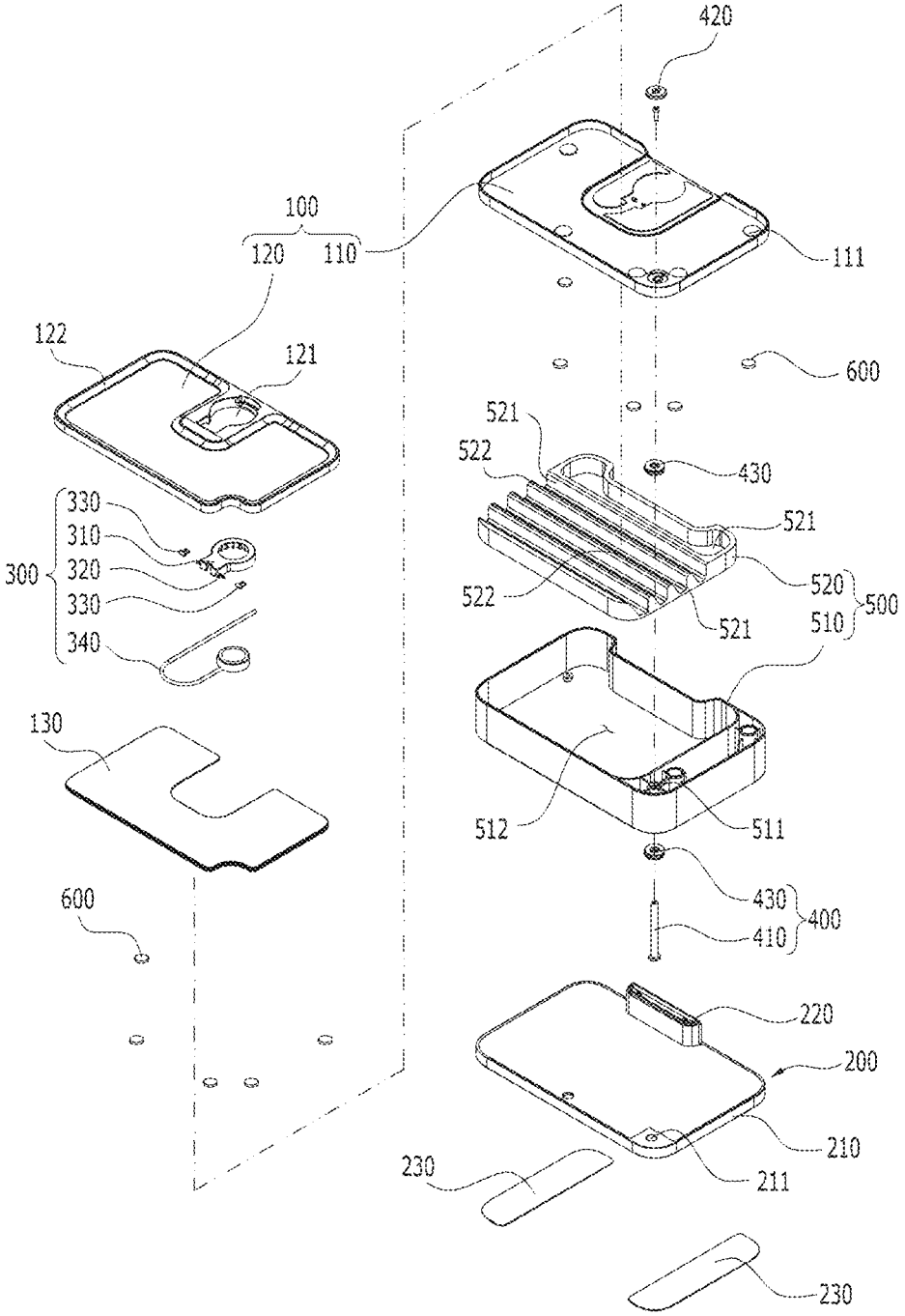
FIG. 2 is an exploded perspective view illustrating the holder and item storage apparatus for portable electronic equipment, according to the present disclosure.
Figure 3:
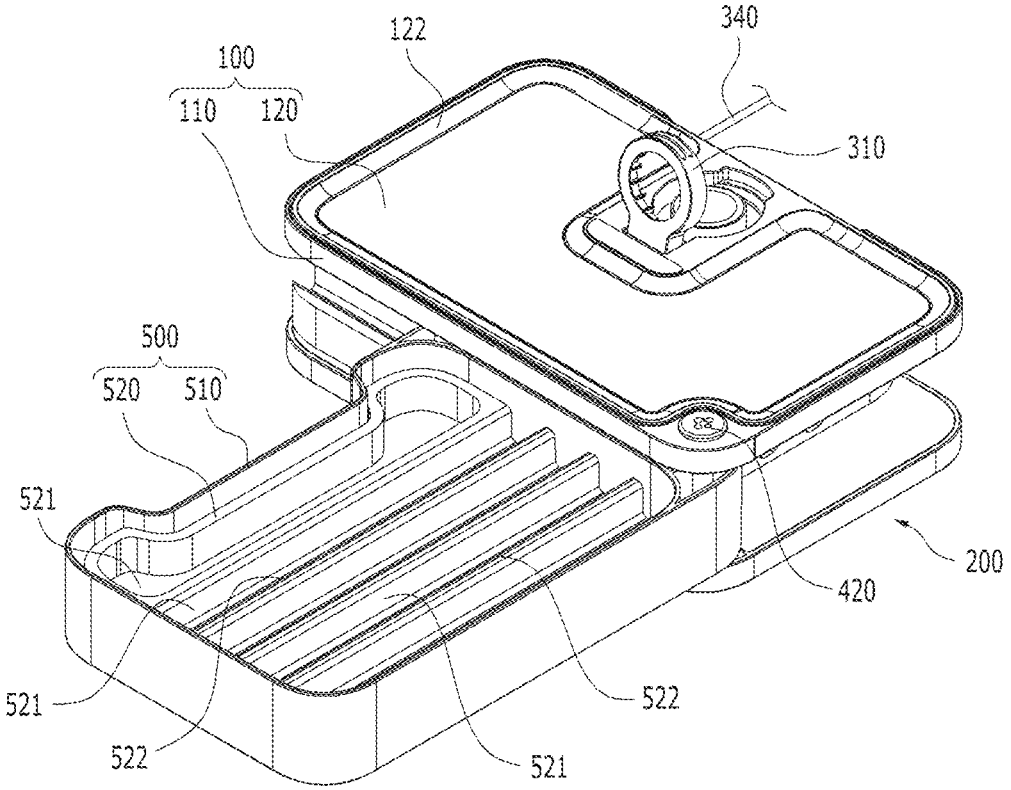
FIG. 3 is a perspective view illustrating a state in which a storage box of the holder and item storage apparatus for portable electronic equipment, according to the present disclosure, is opened.
Figure 4:
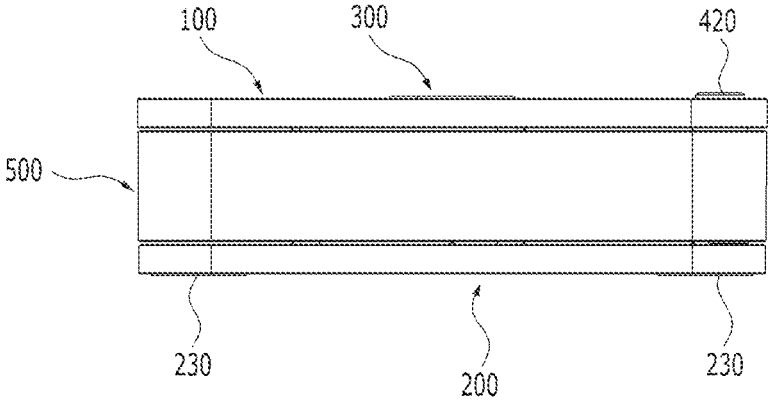
FIG. 4 is a front view illustrating the holder and item storage apparatus for portable electronic equipment, according to the present disclosure.
Figure 5:
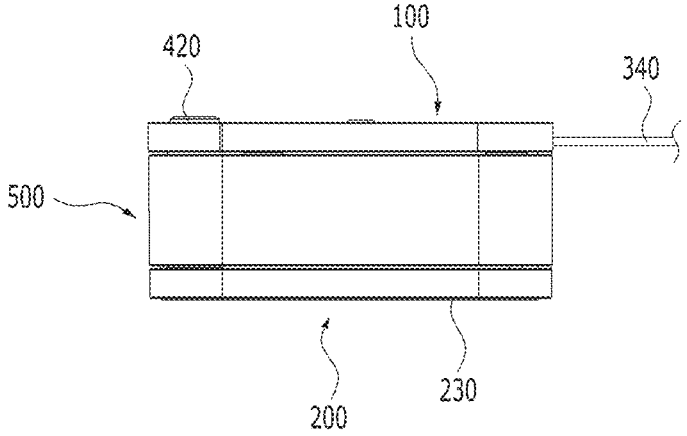
FIG. 5 is a side view illustrating the holder and item storage apparatus for portable electronic equipment, according to the present disclosure.
Figure 6:
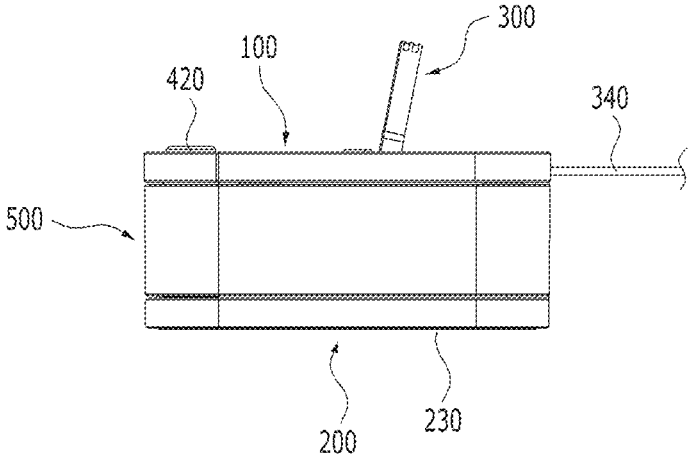
FIG. 6 is a side view illustrating a state in which a holding part of the holder and item storage apparatus for portable electronic equipment, according to the present disclosure, is erected.
Figure 7:
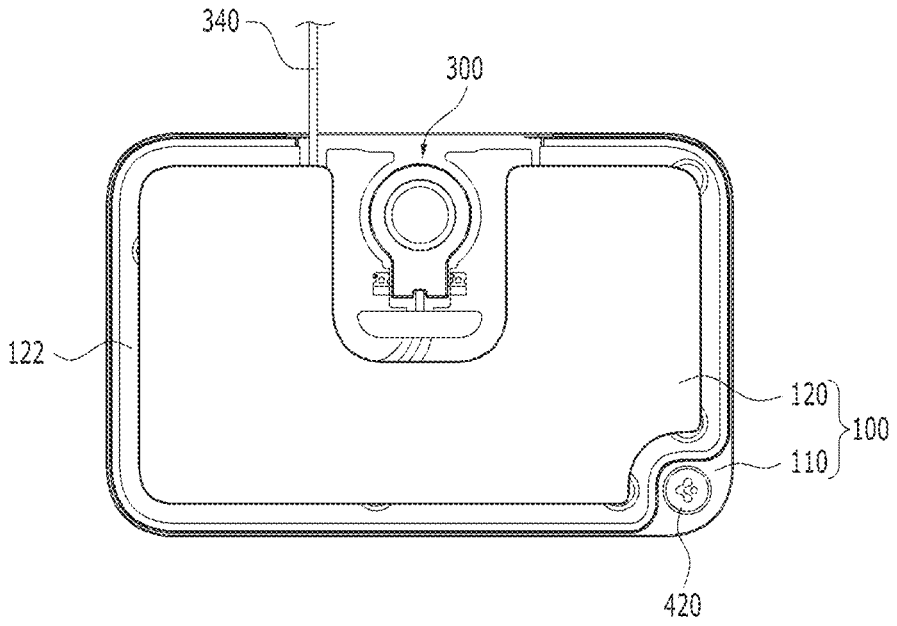
FIG. 7 is a plan view illustrating the holder and item storage apparatus for portable electronic equipment, according to the present disclosure.
Figure 8:
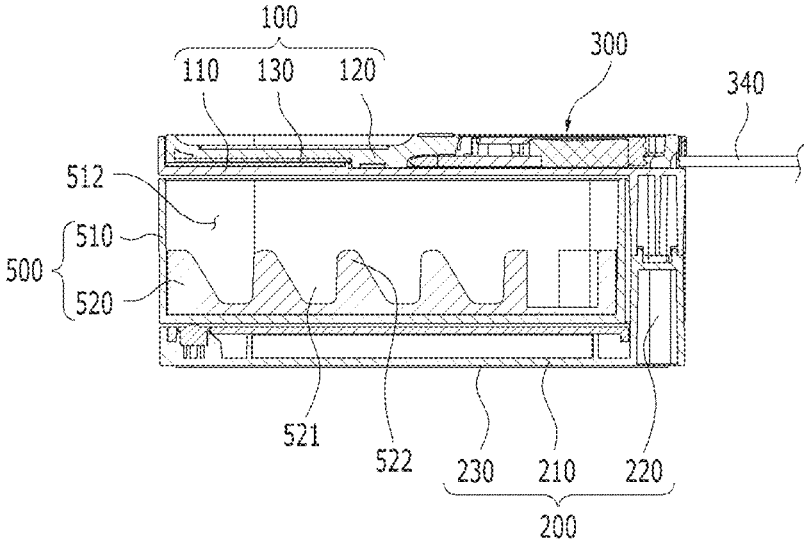
FIG. 8 is a cross-sectional view illustrating the holder and item storage apparatus for portable electronic equipment, according to the present disclosure.
Figure 9:
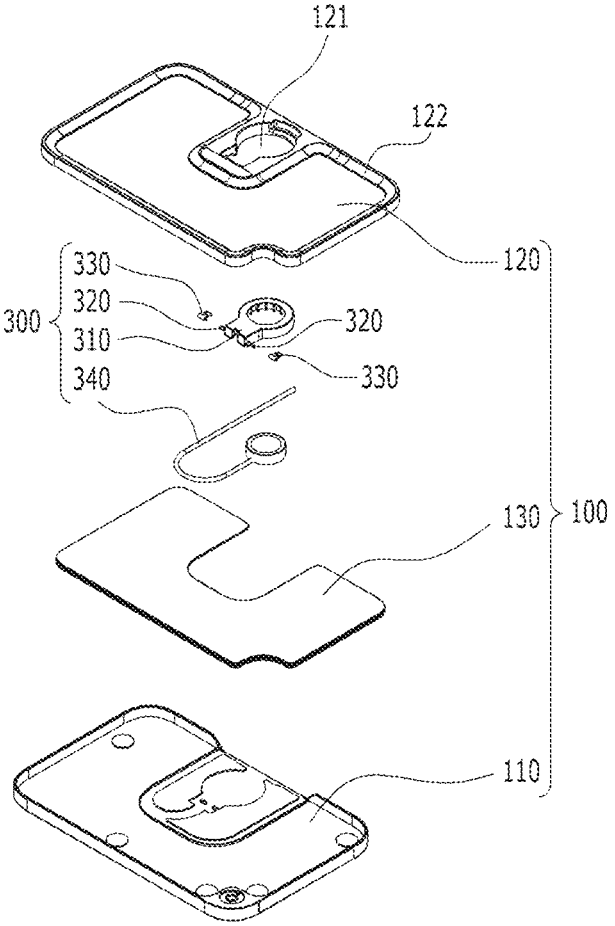
FIG. 9 is an exploded perspective view illustrating a first frame part and the holding part of the holder and item storage apparatus for portable electronic equipment, according to the present disclosure.
Figure 10:
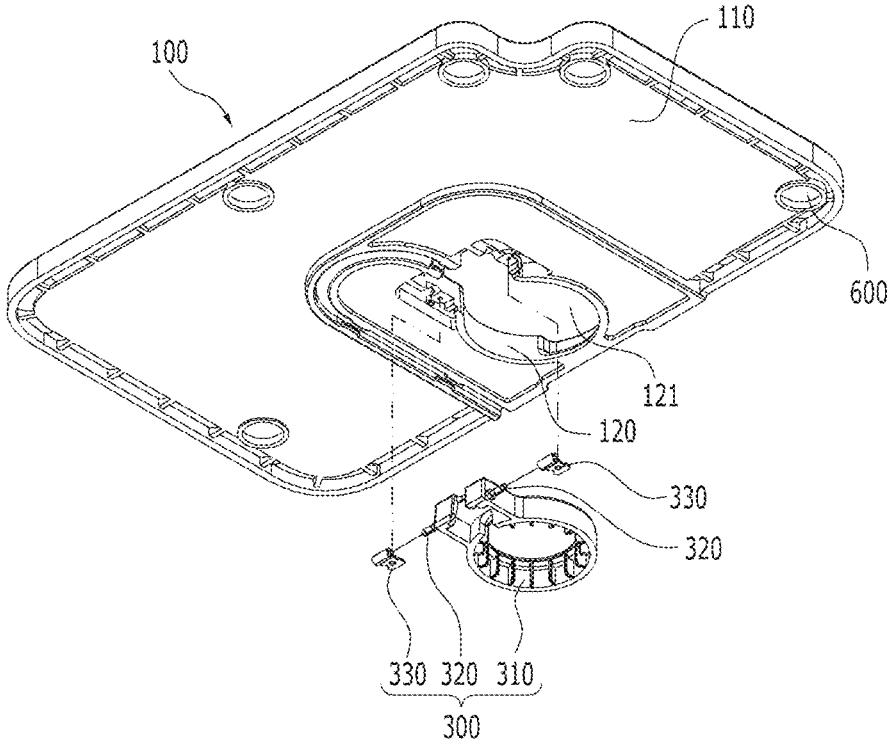
FIG. 10 is a bottom perspective view illustrating a state before the first frame part and the holding part of the holder and item storage apparatus for portable electronic equipment, according to the present disclosure, are connected.
Figure 11:
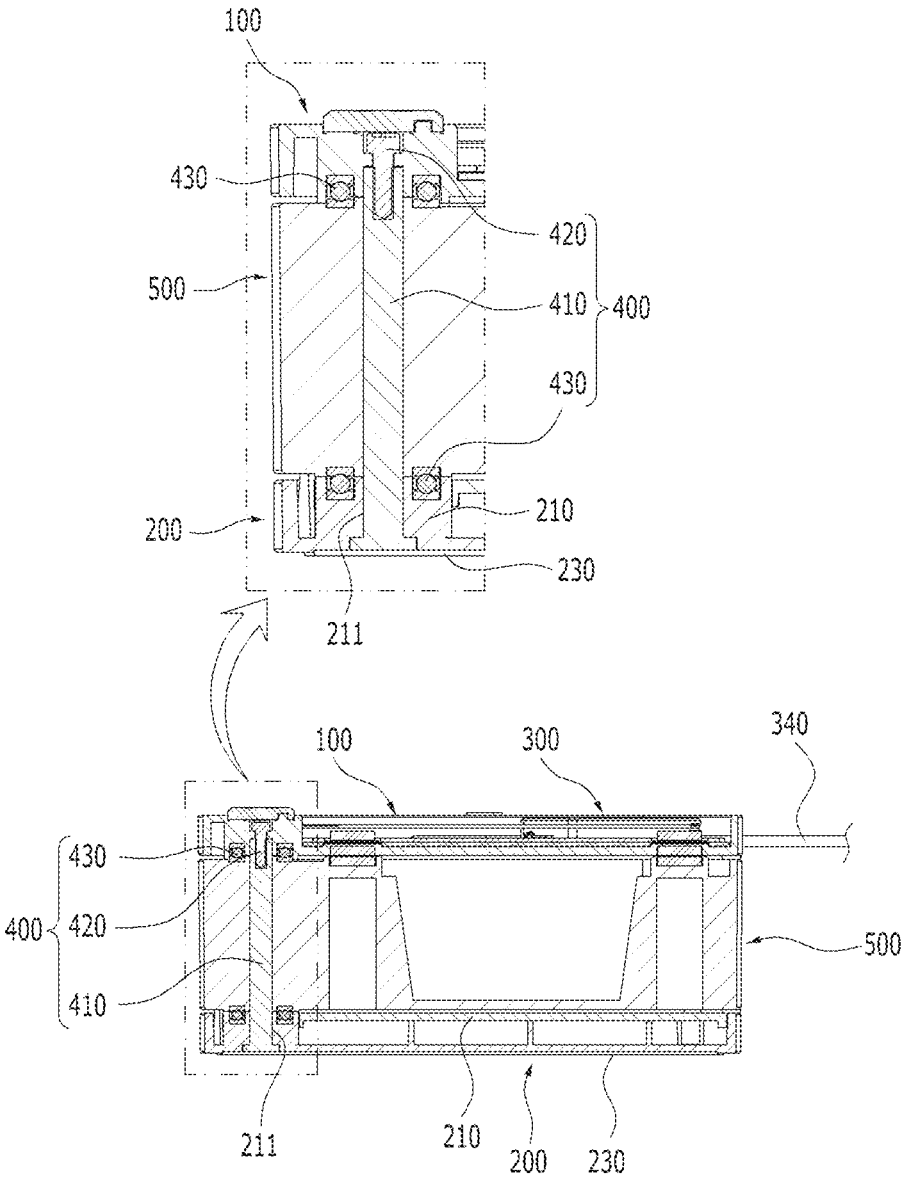
FIG. 11 is a cross-sectional view illustrating a state in which a storage box of the holder and item storage apparatus for portable electronic equipment, according to the present disclosure, is connected.
Figure 12:
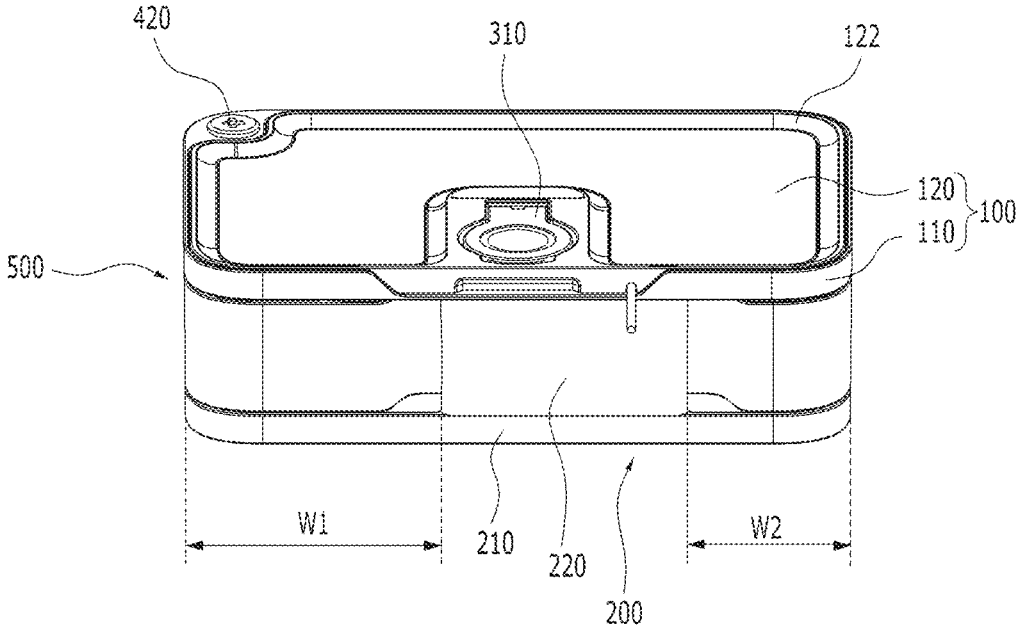
FIG. 12 is a rear perspective view illustrating the holder and item storage apparatus for portable electronic equipment, according to the present disclosure.
Figure 13:
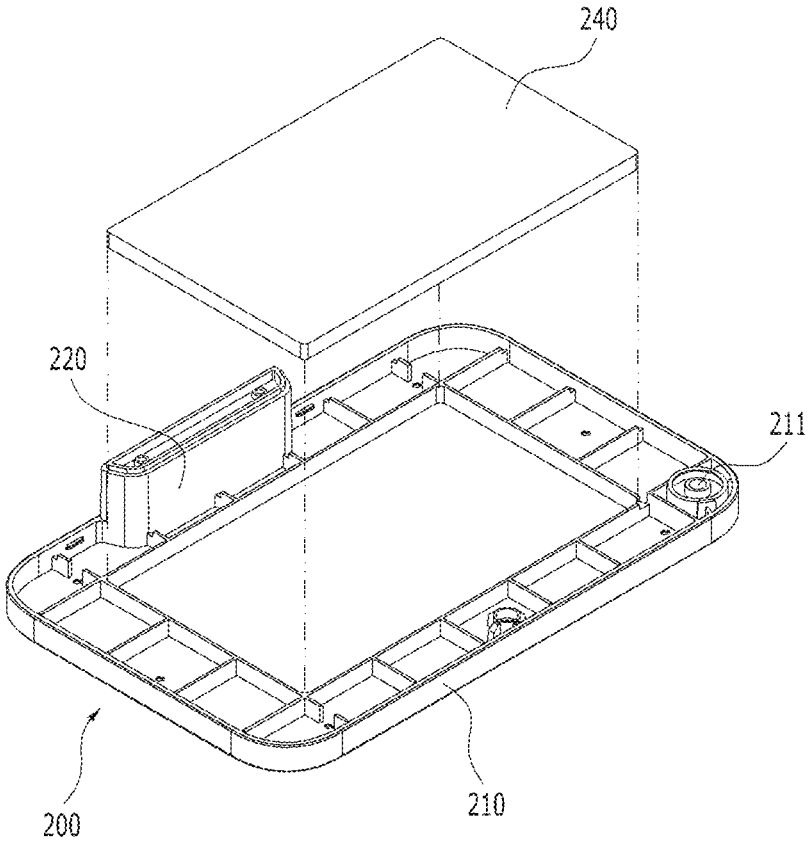
FIG. 13 is a perspective view illustrating a second frame part of the holder and item storage apparatus for portable electronic equipment, according to the present disclosure.
Figure 14:
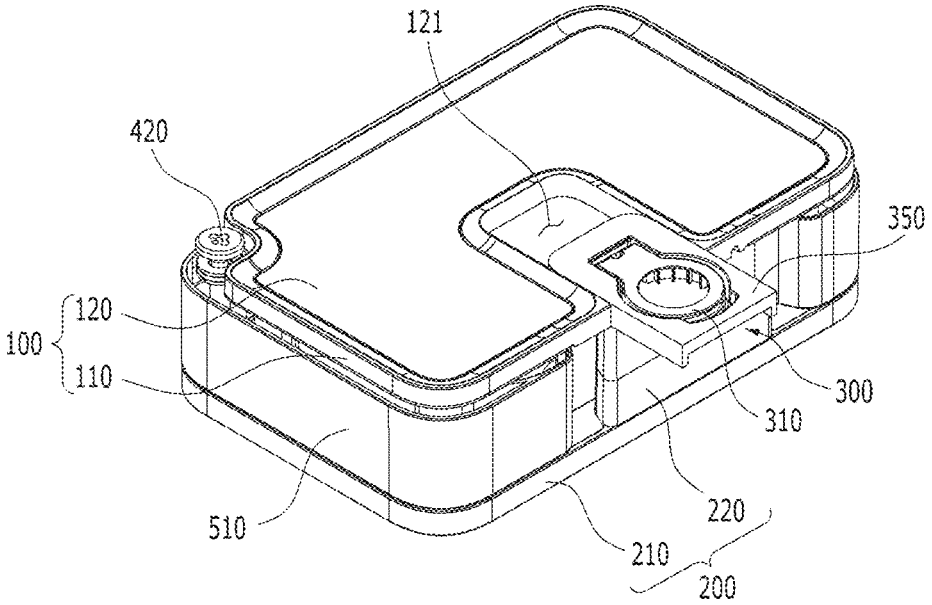
FIG. 14 is a perspective view illustrating an example of the holding part of the holder and item storage apparatus for portable electronic equipment, according to the present disclosure.
Figure 15:
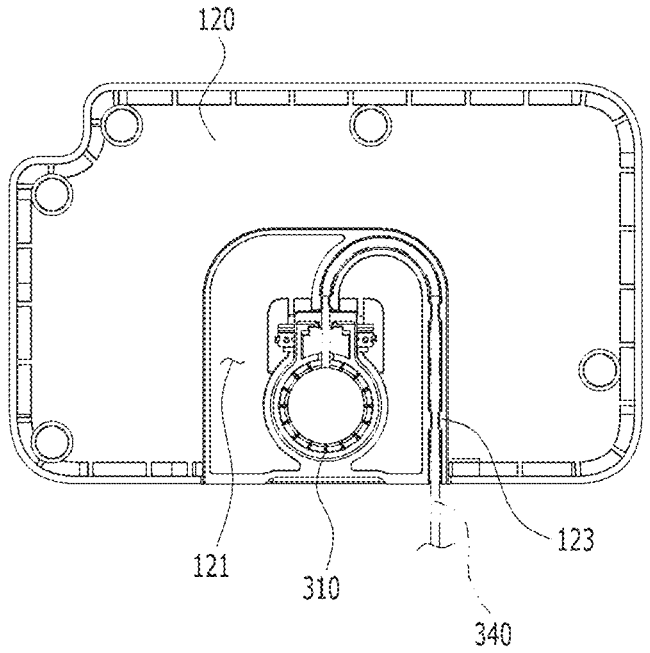
FIG. 15 is a bottom perspective view illustrating an upper frame of the holder and item storage apparatus for portable electronic equipment, according to the present disclosure.
Figure 16:
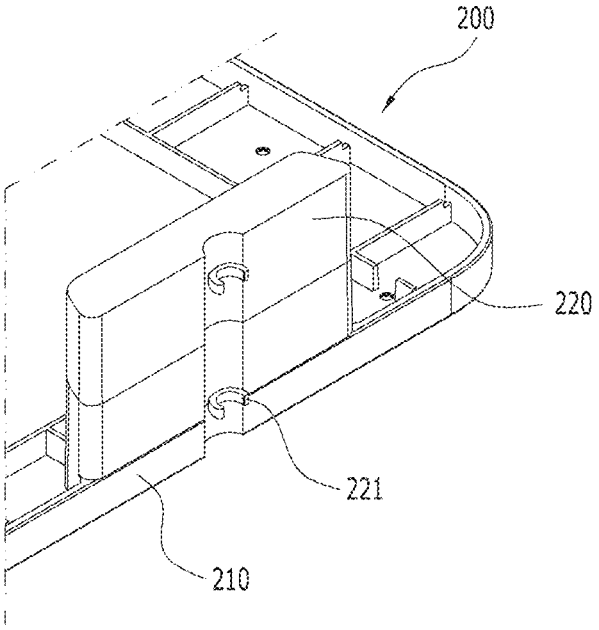
FIG. 16 is a rear perspective view illustrating the second frame part of the holder and item storage apparatus for portable electronic equipment, according to the present disclosure.
Figure 17:
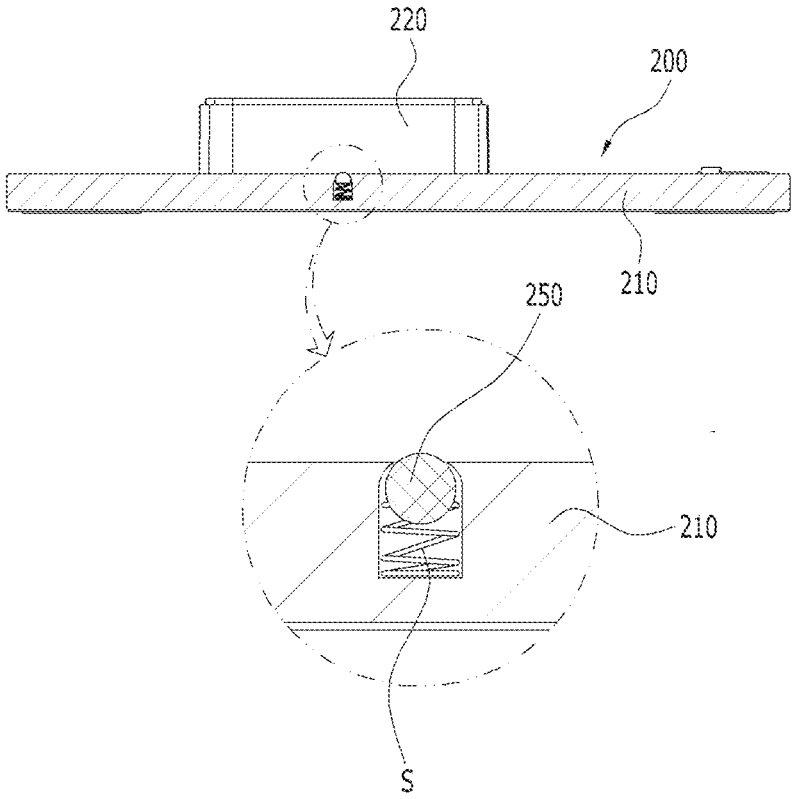
FIG. 17 is a front view illustrating the second frame part of the holder and item storage apparatus for portable electronic equipment, according to the present disclosure.

FIG. 1 is a perspective view illustrating a holder and item storage apparatus for portable electronic equipment, according to the present disclosure, FIG. 2 is an exploded perspective view illustrating the holder and item storage apparatus for portable electronic equipment, according to the present disclosure, FIG. 3 is a perspective view illustrating a state in which a storage box of the holder and item storage apparatus for portable electronic equipment, according to the present disclosure, is opened, FIG. 4 is a front view illustrating the holder and item storage apparatus for portable electronic equipment, according to the present disclosure, FIG. 5 is a side view illustrating the holder and item storage apparatus for portable electronic equipment, according to the present disclosure, FIG. 6 is a side view illustrating a state in which a holding part of the holder and item storage apparatus for portable electronic equipment, according to the present disclosure, is erected, FIG. 7 is a plan view illustrating the holder and item storage apparatus for portable electronic equipment, according to the present disclosure, FIG. 8 is a cross-sectional view illustrating the holder and item storage apparatus for portable electronic equipment, according to the present disclosure, FIG. 9 is an exploded perspective view illustrating a first frame part and the holding part of the holder and item storage apparatus for portable electronic equipment, according to the present disclosure, FIG. 10 is a bottom perspective view illustrating a state before the first frame part and the holding part of the holder and item storage apparatus for portable electronic equipment, according to the present disclosure, are connected, FIG. 11 is a cross-sectional view illustrating a state in which a storage box of the holder and item storage apparatus for portable electronic equipment, according to the present disclosure, is connected, FIG. 12 is a rear perspective view illustrating the holder and item storage apparatus for portable electronic equipment, according to the present disclosure, FIG. 13 is a perspective view illustrating a second frame part of the holder and item storage apparatus for portable electronic equipment, according to the present disclosure, FIG. 14 is a perspective view illustrating an example of the holding part of the holder and item storage apparatus for portable electronic equipment, according to the present disclosure, FIG. 15 is a bottom perspective view illustrating an upper frame of the holder and item storage apparatus for portable electronic equipment, according to the present disclosure, FIG. 16 is a rear perspective view illustrating the second frame part of the holder and item storage apparatus for portable electronic equipment, according to the present disclosure, and FIG. 17 is a front view illustrating the second frame part of the holder and item storage apparatus for portable electronic equipment, according to the present disclosure.

As illustrated in FIGS. 1 to 8, a holder and item storage apparatus for portable electronic equipment according to one embodiment of the present disclosure includes a first frame part 100, a second frame part 200, a holding part 300, a rotating part 400, and a storage box 500. The first frame part 100 is formed as a plate of a certain shape.

Referring to FIGS. 2 and 9, the first frame part 100 includes a main body frame 110 that is disposed in an upper portion of the storage box 500, an upper frame 120 that is provided in the upper portion of the main body frame 110, and a cover sheet 130 that is attached to a lower portion of the upper frame 120. The main body frame 110 is formed with at least one magnet fitting groove 111 into which a magnet 600 is fitted. The upper frame 120 is formed with a charging part 121 to which the holding part 300 is connected.

Referring to FIG. 15, at least one fitting protrusion 123 is formed in the charging part 121 of the upper frame 120 to physically fix (or hold, accommodate, etc.) a cable 340. In addition, a protrusion piece 122 is formed on a circumferential surface of an upper portion of the upper frame 120 to protrude upward. Accordingly, objects may be placed on the upper portion of the upper frame 120, and the objects placed on the protrusion piece 122 may not fall. The second frame part 200 is provided below a lower portion of the first frame part 100. In this case, the second frame part 200 is provided at a distance from the first frame part 100 to which the storage box 500 is connected.

Referring to FIG. 2, the second frame part 200 includes a lower frame 210 for supporting the first frame part 100 and the storage box 500, and a connecting piece 220 disposed on an upper portion of the lower frame 210, which is coupled to the first frame part 100 and is in contact with the storage box 500. That is, the storage box 500, positioned between the first frame part 100 and the second frame part 200, is connected using a space formed by the connecting piece 220. In addition, a shaft connecting groove 211 to which a rotating shaft 410 of a rotating part 400 is connected is formed in the lower frame 210.

Referring to FIG. 17, a ball 250 is provided in the lower frame 210 so that the storage box 500 may move smoothly. In this case, the ball 250 may be elastically supported by a spring S so that a portion thereof protrudes outward.

Meanwhile, as illustrated in FIG. 12, the connecting piece 220 is formed at an asymmetrical position where a larger width portion W1, which is formed on one side of the connecting piece 220, and a smaller width portion W2, which is formed on the other side of the connecting piece 220, are different in size from each other. In other words, the connecting piece 220 is not positioned at the exact center of the lower frame 210. Accordingly, when the storage box 500 is opened using the rotating part 400 as an axis, the smaller width portion W2 is opened and the large width portion W1 is caught between the first frame part 100 and the second frame part 200 so that the storage box 500 may be stably supported without tilting forward.

Referring to FIG. 16, the connecting piece 220 is provided with a fixing part 221 to physically hold the cable 340. For example, the fixing part 221 may be formed in various shapes, such as a clamp shape, a ring shape, and a protrusion shape.

Referring to FIGS. 2 and 8, an anti-slip pad 230 made of a rubber material is provided on a bottom surface of the second frame part 200. In one example embodiment, at least one anti-slip pad 230 is provided to increase anti-slip efficiency.

As illustrated in FIG. 13, a weight 240 is provided inside the lower frame 210. In one example embodiment, at least one weight 240 is provided. Accordingly, when the storage box 500 is opened by the weight 240, the second frame part 200 does not tilt even under the weight of the storage box 500 and one or more items being stored therein. The holding part 300 is provided on the first frame part 100 to hold portable electronic equipment, such as a smartphone or a smartwatch.

Referring to FIG. 9, the holding part 300 includes a holder 310 that is provided in the charging part 121 of the upper frame 120, a hinge 320 that is connected to the holder 310 to rotate the holder 310, and an angle adjustment member 330 that is connected to the first frame part 100 and fitted with the hinge 320 to adjust the rotation angle of the holder 310. Therefore, the holder 310 is provided in the charging part 121 of the upper frame 120 and is connected by the hinge 320 to hold the portable electronic equipment, such as a smartphone or a smartwatch, while rotating around the hinge 320 as an axis.

In one example embodiment, the holding part 300 is provided with a wireless charging module that generates an electromagnetic field to charge a battery built into the portable electronic equipment, such as a smartphone or a smartwatch. Since the wireless charging module is already widely used, the detailed configuration and operation thereof will be omitted. In addition, as illustrated in FIG. 3, the cable 340 for wired charging is connected to the holder 310.

Referring to FIG. 14, the holding part 300 further includes a guide member 350 that is provided on outside of the holder 310 and move in a sliding manner within the charging part 121, where the holding part 300 is detachably connected to the first frame part 100. Accordingly, the holding part 300 moves forward and backward and/or left and right with respect to the first frame part 100. As illustrated in FIG. 11, the rotating part 400 is vertically connected to the first frame part 100 and the second frame part 200 to rotate the storage box 500 with respect to the rotating shaft 410. Referring to FIG. 11, the rotating part 400 is provided with the rotating shaft 410 that is connected to the first frame part 100 and the second frame part 200. In this case, the rotating shaft 410 is connected, for example, by a screw 420, etc.

In addition, the storage box 500 is connected to the rotating shaft 410 to rotate around the rotating shaft 410 as an axis. In addition, the rotating shaft 410 is provided with a bearing 430 so that the storage box 500 rotates smoothly. The storage box 500 is provided between the first frame part 100 and the second frame part 200 and is connected to the rotating part 400 so that it may enter inside of the first frame part 100 and the second frame part 200 while rotating horizontally around the rotating shaft 410 of the rotating part 400 as an axis, thereby closing or opening the storage box 500. The storage box 500 can rotate 360° through the rotating part 400, but for the purpose of usability, the rotation of the storage box 500 may be limited to 90° to 120°.

Referring to FIGS. 2 and 3, the storage box 500 includes a housing 510 to which the rotating part 400 is connected, and a storage rack 520 that is accommodated in the housing 510 and stores items. One side of the housing 510 is formed with the insertion groove 511 to which the rotating shaft 410 of the rotating part 400 is connected, and an inside thereof is formed with a receiving part 512 in which the storage rack 520 is received. In addition, the storage rack 520 is seated in the receiving part 512 of the housing 510 to store items. In addition, the storage rack 520 is formed with at least one insertion part 521 to store items. In this case, the insertion part 521 is separated by at least one partition wall 522, and the items stored in the insertion part 521 are separated without overlapping each other by the partition wall 522.

As illustrated in FIG. 2, the first frame part 100 and the storage box 500 are provided with a magnet 600 to stop the rotation of the storage box 500 when the storage box 500 is positioned within the first frame part 100 and the second frame part 200. In one example embodiment, at least one magnet 600 is provided. In this way, according to the present disclosure, the portable electronic equipment, such as a smartphone or a smartwatch and various items, are put on the first frame part 100 and stored, so it is easy to find and protect the items stored therein.

In addition, since the holding part 300, which is erected through rotating by the hinge 320, is provided on the first frame part 100, it is possible to hold the portable electronic equipment on the holding part 300 and charge the battery. Further, since the storage box 500 is provided between the first frame part 100 and the second frame part 200, and the storage rack 520 in which at least one insertion part 521 is formed in the storage box 500 is provided, various items may be stored in the insertion part 521, so a user may be easy to find necessary items and keep the items tidy. Moreover, the rotating part 400 is connected to the first frame part 100 and the second frame part 200, and the storage box 500 is rotatably connected to the rotating part 400. Accordingly, the storage box 500 is opened by rotating around the rotating part 400 to easily take out necessary items, and the storage box 500 is pushed in between the first frame part 100 and the second frame part 200 to close the storage box 500, thus preventing access to the items stored therein.

As described above, according to an embodiment of the present disclosure, the holding part for holding the portable electronic equipment, such as a smartphone or a smartwatch, is provided on the first frame part, and the storage box for storing items is rotatably connected between the first frame part and the second frame part, so the portable electronic equipment or various other items may be safely stored while charging.

The effects of the present disclosure are not limited to the above-described effects, and other effects that are not mentioned may be obviously understood by those skilled in the art from the following description.

The embodiments of the present disclosure described above are merely exemplary, and the protection scope of the present disclosure may include various modifications and equivalent examples thereof by a person having ordinary skill in the art of the present disclosure.

What is claimed is:

1. A holder and item storage apparatus for portable electronic equipment, comprising:
- a first frame part;
- a second frame part provided at a distance in a lower portion of the first frame part;
- a holding part provided on the first frame part to hold the portable electronic equipment;
- a rotating part vertically connected to the first frame part and the second frame part; and
- a storage box disposed between the first frame part and the second frame part, wherein the storage box is connected to the rotating part to rotate in a horizontal direction and includes an internal space capable of storing items.

2. The holder and item storage apparatus of claim 1, wherein the first frame part includes:
- a main body frame disposed in an upper portion of the storage box; and
- an upper frame provided in an upper portion of the main body frame and includes a charging part formed to connect with the holding part.

3. The holder and item storage apparatus of claim 2, wherein the charging part is formed with at least one fitting protrusion to hold a cable.

4. The holder and item storage apparatus of claim 2, wherein the holding part includes:
- a holder provided in the charging part of the first frame part;
- a hinge connected to the holder to rotate the holder; and
- an angle adjustment member connected to the first frame part and fitted with the hinge.

5. The holder and item storage apparatus of claim 1, wherein the rotating part includes:
- a rotating shaft connected to the first frame part and the second frame part; and
- a bearing connected to the rotating shaft for smooth rotation of the storage box.

6. The holder and item storage apparatus of claim 1, wherein the storage box includes:
- a housing provided with an insertion groove to connect with the rotating part; and
- a storage rack that is accommodated inside the housing.

7. The holder and item storage apparatus of claim 6, wherein the storage rack is formed with at least one insertion part to store items, and wherein the at least one insertion part is separated by at least one partition wall.

8. The holder and item storage apparatus of claim 1, wherein the second frame part includes:
- a lower frame to support the first frame part and the storage box; and
- a connecting piece disposed in an upper portion of one side of the lower frame and connected to the first frame part.

9. The holder and item storage apparatus of claim 8, wherein an inside of the lower frame is provided with at least one weight.

10. The holder and item storage apparatus of claim 8, wherein a bottom surface of the lower frame is provided with at least one anti-slip pad.

11. The holder and item storage apparatus of claim 8, wherein the connecting piece is provided with a fixing part for holding a cable.

12. The holder and item storage apparatus of claim 1, further comprising at least one magnet provided on the first frame part and the storage box to stop a rotation of the storage box.

13. A holder and item storage apparatus for portable electronic equipment, comprising:

a first frame part;

a second frame part provided in a lower portion of the first frame part at a distance;

a holding part provided on the first frame part and has a wireless charging module for charging a battery built into the portable electronic equipment;

a rotating part vertically connected to the first frame part and the second frame part; and a storage box disposed between the first frame part and the second frame part, wherein the storage box is connected to the rotating part to rotate in a horizontal direction and includes an internal space capable of storing items.

14. The holder and item storage apparatus of claim 13, wherein the first frame part includes:

a main body frame disposed in an upper portion of the storage box; and an upper frame provided in an upper portion of the main body frame and includes a charging part formed to connect with the holding part.

15. The holder and item storage apparatus of claim 14, wherein the charging part is formed with at least one fitting protrusion to hold a cable.

16. The holder and item storage apparatus of claim 14, wherein the holding part includes:

a holder provided in the charging part of the first frame part;

a hinge connected to the holder to rotate the holder; and an angle adjustment member connected to the first frame part and fitted with the hinge.

17. The holder and item storage apparatus of claim 13, wherein the rotating part includes:

a rotating shaft connected to the first frame part and the second frame part; and a bearing connected to the rotating shaft for smooth rotation of the storage box.

18. A holder and item storage apparatus for portable electronic equipment, comprising:

a first frame part;

a second frame part provided at a distance in a lower portion of the first frame part;

a holding part provided on the first frame part and the holding part to move in a sliding manner through a guide member;

a rotating part vertically connected to the first frame part and the second frame part; and a storage box that disposed between the first frame part and the second frame part, wherein the storage box is connected to the rotating part to rotate in a horizontal direction and includes an internal space capable of storing items.

19. The holder and item storage apparatus of claim 18, wherein the first frame part includes:

a main body frame disposed in an upper portion of the storage box; and an upper frame provided in an upper portion of the main body frame and includes a charging part formed to connect with the holding part.

20. The holder and item storage apparatus of claim 19, wherein the holding part includes:

a holder provided in the charging part of the first frame part;

a hinge connected to the holder to rotate the holder; and an angle adjustment member connected to the first frame part and fitted with the hinge.

* * * * *